US007798347B2

(12) United States Patent
Rees

(10) Patent No.: US 7,798,347 B2
(45) Date of Patent: Sep. 21, 2010

(54) FEEDING BOTTLE

(75) Inventor: Arnold Edward Rees, Newcastle Upon Tyne (GB)

(73) Assignee: Jackel International Limited, Cramlington, Northumberland (GB)

( * ) Notice: Subject to any disclaimer, the term of this patent is extended or adjusted under 35 U.S.C. 154(b) by 650 days.

(21) Appl. No.: 11/596,546

(22) PCT Filed: May 17, 2005

(86) PCT No.: PCT/GB2005/001883

§ 371 (c)(1),
(2), (4) Date: Sep. 7, 2007

(87) PCT Pub. No.: WO2005/112869

PCT Pub. Date: Dec. 1, 2005

(65) Prior Publication Data

US 2008/0099422 A1 May 1, 2008

(30) Foreign Application Priority Data

May 17, 2004 (GB) ..... 0410993.0

(51) Int. Cl.
*A61J 9/04* (2006.01)
*A61J 11/02* (2006.01)
*B65D 51/16* (2006.01)

(52) U.S. Cl. ..... 215/11.5; 215/11.1; 215/11.4; 220/202; 220/203.01; 220/360; 220/361

(58) Field of Classification Search ..... 215/11.1, 215/11.4, 11.5, 902; 220/202, 203.01, 227, 220/360, 361, 366.1, 367.1, 745, DIG. 27
See application file for complete search history.

(56) References Cited

U.S. PATENT DOCUMENTS

| | | | |
|---|---|---|---|
| 380,835 | A | 4/1888 | Ware |
| 3,207,349 | A | 9/1965 | Rabe |
| 3,704,803 | A | 12/1972 | Ponder |
| 3,946,888 | A | 3/1976 | Tonkin |

(Continued)

FOREIGN PATENT DOCUMENTS

DE 19716535 A1 11/1997

(Continued)

OTHER PUBLICATIONS

International Search Report for PCT/GB2005/002532 mailed Dec. 7, 2005.

(Continued)

*Primary Examiner*—Anthony Stashick
*Assistant Examiner*—Madison L Wright
(74) *Attorney, Agent, or Firm*—Ungaretti & Harris LLP

(57) ABSTRACT

A feeding bottle (10) comprises a container (16), a teat (12) and a collar (14) to screw the teat (12) onto and seal the container (16). A vent assembly (18) is mounted between the teat (12) and the container (16) and includes a vent tube (22) passing down to a position close to the base of the container (16) and having a one way valve (34) allowing air to pass into the container (16) on application of suction to the teat (12) but preventing liquid flowing into the vent tube (22), together with a valve flange (36) acting as an anti-choke member.

16 Claims, 6 Drawing Sheets

U.S. PATENT DOCUMENTS

| | | | | |
|---|---|---|---|---|
| 4,834,099 | A | 5/1989 | Schrooten | |
| 4,993,568 | A | 2/1991 | Morifuji et al. | |
| 5,101,991 | A | 4/1992 | Morifuji et al. | |
| 5,474,028 | A | 12/1995 | Larson et al. | |
| 5,544,766 | A | 8/1996 | Dunn et al. | |
| 5,570,796 | A | 11/1996 | Brown et al. | |
| D384,748 | S | 10/1997 | Dunn | |
| 5,673,806 | A | 10/1997 | Busnel | |
| 5,678,710 | A | 10/1997 | Sheu | |
| 5,779,071 | A | 7/1998 | Brown et al. | |
| D404,138 | S | 1/1999 | Meyers et al. | |
| D405,530 | S | 2/1999 | Manganiello et al. | |
| 5,881,893 | A | 3/1999 | Manganiello | |
| D412,582 | S | 8/1999 | Morano | |
| D421,306 | S | 2/2000 | Meyers et al. | |
| 6,032,810 | A | 3/2000 | Meyers et al. | |
| 6,068,147 | A * | 5/2000 | Sheu | 215/11.5 |
| 6,161,710 | A | 12/2000 | Dieringer et al. | |
| D441,870 | S | 5/2001 | Randolph | |
| D444,239 | S | 6/2001 | Kobayashi et al. | |
| 6,241,110 | B1 | 6/2001 | Hakim | |
| 6,305,570 | B1 * | 10/2001 | Atkin et al. | 220/714 |
| D459,815 | S | 7/2002 | Pastucha | |
| D463,567 | S | 9/2002 | Morano | |
| D464,434 | S | 10/2002 | Morano | |
| D465,028 | S | 10/2002 | Renz | |
| 6,499,615 | B1 | 12/2002 | Szieff | |
| D479,606 | S | 9/2003 | Randolph | |
| 6,645,228 | B2 | 11/2003 | Renz | |
| D486,579 | S | 2/2004 | Dunn | |
| D488,560 | S | 4/2004 | Renz et al. | |
| D498,849 | S | 11/2004 | Randolph et al. | |
| 6,883,672 | B2 | 4/2005 | Dunn et al. | |
| D504,723 | S | 5/2005 | Randolph et al. | |
| D504,724 | S | 5/2005 | Randolph et al. | |
| D504,725 | S | 5/2005 | Randolph et al. | |
| 6,984,688 | B2 | 1/2006 | Gu | |
| 6,994,225 | B2 | 2/2006 | Hakim | |
| D520,142 | S | 5/2006 | Mallet | |
| 7,122,045 | B2 | 10/2006 | Randolph et al. | |
| 7,150,370 | B2 | 12/2006 | Pyun | |
| 2002/0030029 | A1 | 3/2002 | Hakim | |
| 2002/0063103 | A1 | 5/2002 | Kiernan | |
| 2003/0032984 | A1 | 2/2003 | Hakim | |
| 2003/0106872 | A1 | 6/2003 | Lin | |
| 2004/0026351 | A1 | 2/2004 | Dunn et al. | |
| 2004/0089626 | A1 | 5/2004 | Pyun | |
| 2004/0188373 | A1 | 9/2004 | Lewis et al. | |
| 2004/0226906 | A1 | 11/2004 | Peterson | |
| 2004/0256345 | A1 | 12/2004 | Lundquist | |
| 2005/0035078 | A1 | 2/2005 | Lieberman et al. | |
| 2005/0056611 | A1 | 3/2005 | Hakim | |
| 2005/0184022 | A1 | 8/2005 | Dunn et al. | |
| 2005/0224444 | A1 | 10/2005 | Akihiro | |
| 2005/0247658 | A1 | 11/2005 | Renz | |
| 2005/0252875 | A1 | 11/2005 | Sheu et al. | |
| 2005/0277987 | A1 | 12/2005 | Randolph et al. | |
| 2005/0288712 | A9 | 12/2005 | Hakim | |
| 2007/0045214 | A1 | 3/2007 | Jennings | |

FOREIGN PATENT DOCUMENTS

| | | | |
|---|---|---|---|
| DE | 19849271 | A1 | 4/2000 |
| DE | 20210121 | U | 10/2002 |
| EP | 0151862 | A | 8/1985 |
| EP | 0845971 | | 10/2001 |
| EP | 1297814 | A | 4/2003 |
| EP | 1310230 | A | 5/2003 |
| GB | 0004210 | A | 6/1912 |
| GB | 2139903 | A | 11/1984 |
| GB | 2154451 | A1 | 9/1985 |
| GB | 2167735 | A | 6/1986 |
| GB | 2250017 | A | 5/1992 |
| GB | 2351729 | A | 1/2001 |
| GB | 2402347 | A | 12/2004 |
| GB | 2412114 | A | 9/2005 |
| JP | 01313056 | A | 12/1989 |
| JP | 02144065 | A | 6/1990 |
| JP | 05084279 | A | 4/1993 |
| JP | 05115535 | A | 5/1993 |
| JP | 2000000288 | A | 1/2000 |
| JP | 2000135270 | A | 5/2000 |
| JP | 2000189496 | A | 7/2000 |
| JP | 2000271193 | A | 10/2000 |
| JP | 2001009008 | A | 1/2001 |
| JP | 2001187117 | A | 7/2001 |
| JP | 2001299877 | A | 10/2001 |
| JP | 2001299878 | A | 10/2001 |
| JP | 2002011076 | A | 1/2002 |
| JP | 2002200144 | A | 7/2002 |
| JP | 2002306572 | A | 10/2002 |
| JP | 2003144529 | A | 5/2003 |
| JP | 2003205018 | A | 7/2003 |
| JP | 2004129940 | A | 4/2004 |
| JP | 2006006809 | A | 1/2006 |
| JP | 2006068360 | A | 3/2006 |
| WO | WO-9825571 | A | 6/1999 |
| WO | WO-00/54726 | A | 9/2000 |
| WO | WO-03092577 | A | 11/2003 |
| WO | WO-2004039304 | A | 5/2004 |
| WO | WO-2004043325 | A | 5/2004 |
| WO | WO-2004/064578 | A1 | 8/2004 |
| WO | WO-2004/065247 | A1 | 8/2004 |
| WO | WO-2005041851 | A | 5/2005 |
| WO | WO-2006011573 | A | 2/2006 |

OTHER PUBLICATIONS

International Search Report for PCT/GB2005/001883 mailed Aug. 11, 2005.
Search Report for GB0414560.3 mailed Mar. 4, 2005.
Search Report for GB0502599.4 mailed May 6, 2005.
Search Report for GB0410993.0 mailed May 19, 2005.

* cited by examiner

FEEDING BOTTLE

CROSS-REFERENCE TO RELATED APPLICATIONS

This Application is a U.S. National filing under §371 of International Application No. PCT/GB2005/001883, with an international filing date of 17 May 2005, now pending, claiming priority from Great Britain Application No. GB2004/10993.0, with a filing date of 17 May 2004, now pending, and herein incorporated by reference.

TECHNICAL FIELD

The invention relates to a feeding bottle for example a vented feeding bottle.

BACKGROUND OF THE INVENTION

Conventional feeding bottles comprise a container and a teat held on the container by a screw-on collar. A problem with conventional feeding bottles is that as an infant sucks on the teat a negative pressure builds up within the container as a result of which it becomes progressively more difficult to feed which can give rise to problems such as colic.

Various solutions have been proposed for alleviating the problem for example providing valves allowing air ingress. One example of such a solution is described in European patent application EP0845971. According to this document a feeding bottle includes a reservoir tube communicating at its upper end with a vent to atmosphere. The reservoir tube has a bulbous upper reservoir portion with an air tube projecting down into it from the air vent. An air conduit portion projects down from the reservoir portion to a point close to the bottom of the container. In the upright position the container is filled with liquid nearly to the height of the reservoir portion. When the container is inverted the end of the air conduit portion projects above the level of the liquid and the liquid previously in the air conduit portion drains into the reservoir portion and sits below the end of the air tube. As a result an air passage is provided from the vent via the air tube into the reservoir portion and through the air conduit to the bottle such that pressure equalisation is provided when the infant drinks. However, there are various disadvantages to this arrangement. Firstly a very complex arrangement is required. Furthermore because no valves are provided, if the infant distorts the teat while feeding for example by biting down on it there is less resistance and liquid is pushed away from the teat.

Another approach is described in U.S. Pat. No. 6,499,615 which describes a bottle having an angled neck and a valved vent tube. Once again complex and specialised components are required for this arrangement which also presents cleaning difficulties and even choking hazards as a result of the numerous small parts involved.

Furthermore, in known valved, vented feeding bottles, during the bottle feeding process the pressures fluctuate between positive and negative throughout the feed. When the infant bites down on or compresses the teat during feeding this action creates positive pressure in the bottle as the milk is pushed back into the bottle, acting on the valve to close it and directing milk flow out of the teat. As the infant creates suction to draw more milk from the bottle a negative pressure is induced in the bottle as milk is dispensed and when this occurs the valve at the end of the tube opens allowing air into the bottle. However in known systems a relatively significant negative pressure is required before the valve opens to allow air to vent such that the infant must suck unnaturally hard before pressure equalisation takes place. Accordingly known systems do not closely mimic natural feeding.

SUMMARY OF THE INVENTION

The invention is set out in the claims. Because the pressure at which the valve opens is minimised, the valve can vent at the very low negative pressures associated with infant feeding as a result of which the bottle provides a close similarity to natural breast feeding.

Furthermore, because of the provision of an anti-choke portion, feeding hazards are reduced and it is found also that the anti-choke portion provides a useful stirring/mixing member. Furthermore, by providing a feeding bottle insert with a sealing portion which itself provides a liquid passage as well as an air vent passage a simple modular constructions is provided.

BRIEF DESCRIPTION OF THE DRAWINGS

Embodiments of the invention will now be described by way of example, with reference to the figures of which.

DETAILED DESCRIPTION OF THE INVENTION

Figure 1:
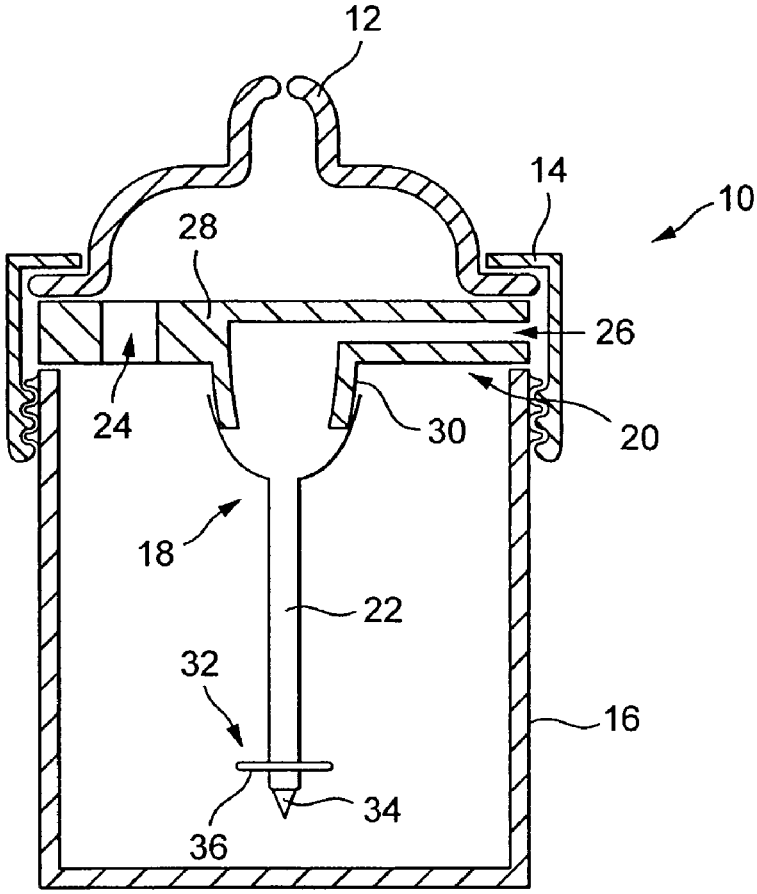
FIG. 1 is a sectional side view of a feeding bottle according to a first embodiment of the present invention.

Referring to FIG. 1, a feeding bottle designated generally 10 includes a teat 12 mounted by a screw collar 14 onto a container 16. As is conventional, the collar 14 includes a central orifice through which the teat protrudes and the teat includes a flange of similar diameter to the container such that when the collar is screwed down a seal is formed by pressure of the collar on the flange of the teat.

The feeding bottle 10 further includes a vent assembly in the form of a neck insert 18 including a head portion 20 and a vent tube 22 projecting downwardly from the head portion. The head portion 20 includes a liquid conduit 24 providing communication between the container 16 and the teat 12 such that when the feeding bottle is inverted liquid passes via the liquid conduit 24 from the container into the teat allowing the infant to feed. Isolated from the liquid conduit 24 the head portion also includes an air passage 26 communicating with the vent tube 22 at one end and with atmosphere at the other end.

The head portion 20 includes an upper flange portion 28 of similar diameter to the container and arranged to fit on the lip of the container to be gripped in a liquid tight condition by the flange of the teat 12 pressed down by the collar 14 as described above. The flange portion 28 is of sufficient thickness to allow a generally radially extending bore to be formed inwardly from the cylindrical side wall providing the air passage 26. The air passage opens to atmosphere via the screw threads of the collar 14 and is sealed against liquid passage by virtue of the seal formed by the neck insert flange portion 28 against the lip of the container 16.

The air passage 26 communicates at its other end with a formation 30 provided on the lower face of the head portion 20 comprising an open-ended chamber on to which the vent tube 22 is an airtight push fit. The vent tube 22 extends downwardly nearly to the bottom of the container and includes at its lower end 32 a one-way valve 34. In the embodiment shown the valve 34 comprises a duck-billed valve of well-known type which allows passage of air in one direction, into the container, but prevents the flow of liquid in the opposite direction, into the vent tube 22. Also provided at the lower end 32 of the vent tube 22 is a valve flange 36 which in the embodiment shown is in fact formed integrally with the valve 34 and both of which are a push fit or otherwise airtight connection to the vent tube 22. The valve flange 36 can form, for example, a ring around and concentric with the vent tube 22 and joined thereto by a web or ribs. The valve flange allows improved mixing and prevents a choking hazard in the event that the valve 34 should become detached for any reason.

In use the neck insert 18 is assembled (or pre-assembled) by fitting the valve 34 and flange 36 on to the vent tube 22 and fitting the vent tube 22 at its other end to the corresponding formation 30 of the head portion 20. The container 16 is filled and the neck insert 18 is placed on the upper lip of the container 16. The teat 12 is then placed on top of the neck insert 18 and the assembly is liquid sealed by screwing the collar 14 down as discussed in more detail above. When mixing is required this can be facilitated by virtue of the valve flange 36. When the container is inverted liquid passes from the container 16 through the liquid conduit 24 in the neck insert 18 into the teat 12. When the infant sucks or feeds on the teat 12, causing a pressure drop in the container 16, air enters the container via the air passage 26, the vent tube 22 and the valve 34 such that pressure is equalised and a vacuum build-up is greatly reduced.

Figure 2:
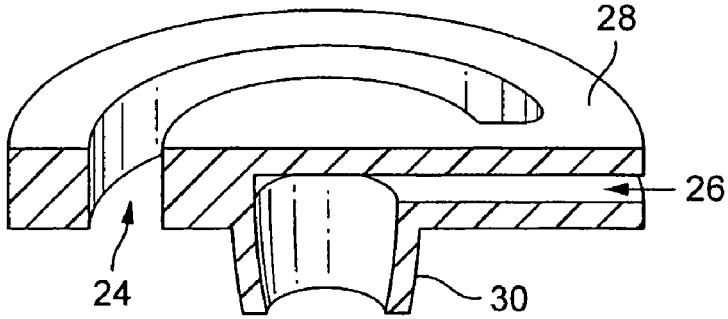
FIG. 2 is a sectional view of a detail of the feeding bottle insert shown in FIG. 1.
Figure 3A:
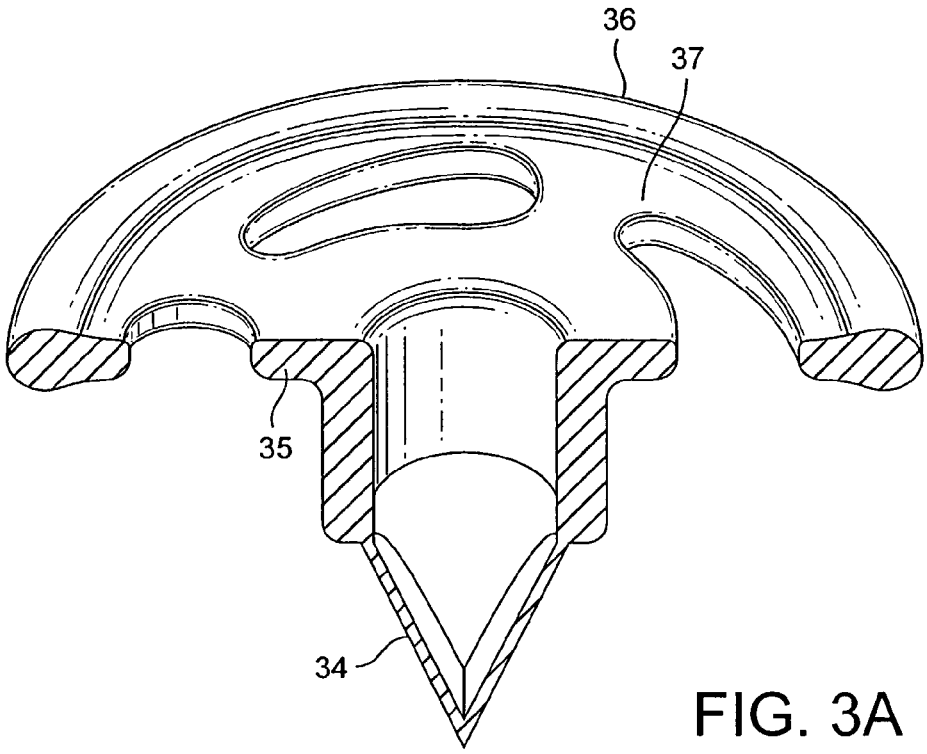
FIG. 3*a* is a sectional perspective view of a valve and valve flange assembly according to an embodiment of the present invention.
Figure 3B:
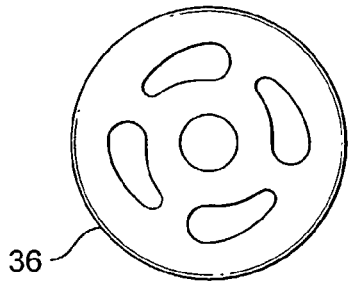
FIG. 3*b* is a top plan view of the valve and valve flange assembly of FIG. 3*a;*
Figure 3C:
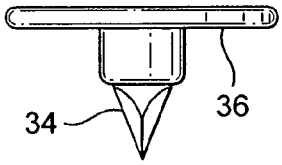
FIG. 3*c* is a front view of the valve and valve flange assembly of FIG. 3*a;*
Figure 3D:
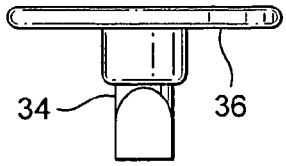
FIG. 3*d* is a side view of the valve and valve flange assembly of FIG. 3*a;*
Figure 3E:
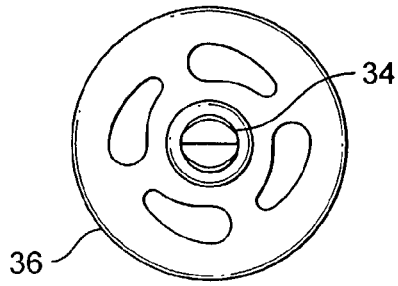
FIG. 3*e* is a bottom plan view of the valve and valve flange assembly of FIG. 3*a;*

Referring to FIG. 2 the head portion 20 of the neck insert 18 is shown in more detail. As can be seen the head portion includes a flange portion 28 that is generally disc shaped and provides a seal around the neck of the container 16 (not shown) and a liquid conduit 24 in the direction perpendicular to the plane of the flange. The air passage 26 passes through the cylindrical wall of the flange portion 28 generally to the centre of the flange portion 28 providing a passage to the formation 30 and vent tube 22 (not shown).

Referring to FIGS. 3*a* to 3*e* the valve 34 and valve flange 36 are shown in more detail and in particular it will be seen that a ring-shaped or other profile of valve flange 36 can be provided and mounted in any appropriate manner for example by virtue of spokes extending from the central hub 35 on which the valve 34 is mounted or by an apertured web 37 as shown.

Figure 4A:
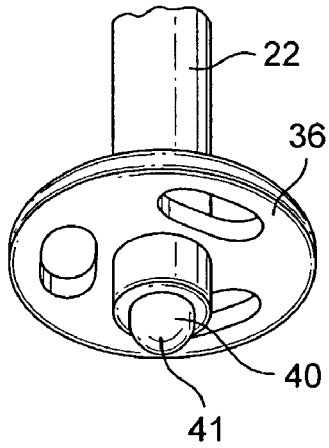
FIG. 4*a* is a perspective view of an alternative valve and valve flange assembly according to and embodiment of the present invention.
Figure 4B:
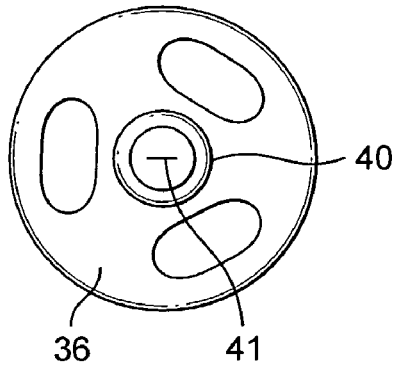
FIG. 4*b* is a bottom plan view of the valve and valve flange assembly of FIG. 4*a;*
Figure 4C:
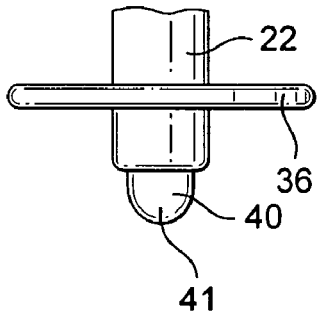
FIG. 4*c* is a side view of the valve and valve flange assembly of FIG. 4*a;*

FIGS. 4*a*, 4*b* and 4*c* show an alternative one way vent valve that can be implemented in the embodiments of present invention. The hemispherical valve 40 comprises a hemispherical shaped membrane with a central slit 41 which allows the passage of air therethrough. Any suitable cut such as a cross is also possible. The slit or cut is dimensioned to allow low pressure air venting as well as high temperature sealing.

The hemispherical valve of FIGS. 4*a* to 4*c* could also be used for other applications. For example, it could be located on the apex of the teat to allow the passage of fluid therethrough or on the flange of the teat to allow passage of air therethrough.

The dimension, material and construction of the valve 34 or 40 is of particular significance in obtaining a natural feeding action for the bottle. Most valving systems currently known allow a teat to vent at approximately 50 mB (milliBar) by virtue of the closing force determined by the resilience of the valve walls surrounding the slit, for example because of their stiffness. As a result, in use, the infant must exert an unnaturally high sucking force before venting can take place which can give rise to problems and results in sucking action more powerful than that required in natural feeding. However in known systems such a high resilient closing force is required to ensure that the valve does not leak milk into the vent tube, for example when the infant exerts squeezing pressure on the teat.

The valve 34 or 40 according to the present invention, on the other hand, is constructed such that a negative pressure in the region of 1 to 25 mB, more preferably 5 to 15 mB and most preferably 10 mB will be sufficient to open the valve to allow venting when the infant sucks on the bottle, requiring significantly less suction by the infant and a more natural feeding action. In particular this is allowed because of the recognition, according to the invention, that it is only necessary to prevent leakage of milk into the valve and vent tube when the bottle is in the upright position (and hence the valve is immersed in milk) whereas when the infant is sucking on the teat the bottle will tend to be inverted such that the valve is positioned above the level of the milk. Even if the valve opens when it is immersed in milk, no liquid will enter the valve and vent tube Accordingly the invention recognises that a less significant resilient closing force is required for the valve because of the additional force applied to the sides of the valve when the bottle is standing upright as a result of the head of pressure exerted by the milk in the bottle. This force provides the additional closing force sufficient to prevent leakage into the valve and vent tube. Accordingly when the infant is drinking from the bottle in its inverted position, because the valve has a smaller resilient closing force it opens under a lower negative pressure as a result of which a more natural feeding action is represented.

It will be appreciated that the skilled reader can fabricate an appropriate duck-billed valve or hemispherical valve to meet the criteria set out above using routine trial and experimentation, for example by varying the wall or membrane thickness and hence stiffness of valves and applying an appropriate negative pressure to obtain venting at the desired pressure and/or by immersing the valves in liquids of a similar density to that of milk or other fluids used by the infant with an appropriate head of pressure, for example 5 to 10 cm. Preferably the valve is fabricated so that it remains closed even with a low head of pressure, for example 5 mm.

In the specific embodiment shown with respect to FIGS. 3*a* to 3*e*, the valve is formed of pure silicone rubber with typical 30 to 60 Shore A hardness as available from any silicone supplier such as GE, Bayer, Dow, Wacker, Rhone Poulenc. Both liquid silicone and compression moulding silicone grades are suitable for the present invention as they provide high heat stability, important for repeated heat sterilising methods. Other grades may also be suitable. The valve walls having a valve thickness 0.5 mm. Viewed from the front the duck-billed valve forms the shape of an inverted triangle of height 10.0 mm and base 8.0 mm. Viewed from the side the duck-billed valve is generally rectangular in cross-section having a width of 7.0 mm. A slit is formed on the exit end of the valve by a cut with a length of 2.5 mm to 4 mm. It is found that this configuration provides the desired operating range and in particular an ability to open up under a negative pressure of just 10 mB.

In the specific embodiment shown with respect to FIGS. 4*a* to 4*c*, the hemispherical valve is formed of pure silicone rubber with typical 30 to 60 Shore A hardness as available from any silicone supplier such as GE, Bayer, Dow, Wacker, Rhone Poulenc. Both liquid silicone and compression moulding silicone grades are suitable for the present invention as they provide high heat stability, important for repeated heat sterilising methods. Other grades may also be suitable. The key dimensions of the hemispherical valve 40 for high temperature sealing are its radius, wall thickness, length of central slit 41 and material softness. The hemispherical valve has a radius of 2 mm to 5 mm, most preferably 3.5 mm, and a wall thickness of 0.3 mm to 0.7 mm, most preferably 0.5 mm. The central slit dimension is in the region of 2.5 mm to 4.0 mm. It is found that this configuration provides low level suction but is also inherently strong enough to withstand pressures associated with liquid up to boiling point temperature without leakage.

Figure 5A:
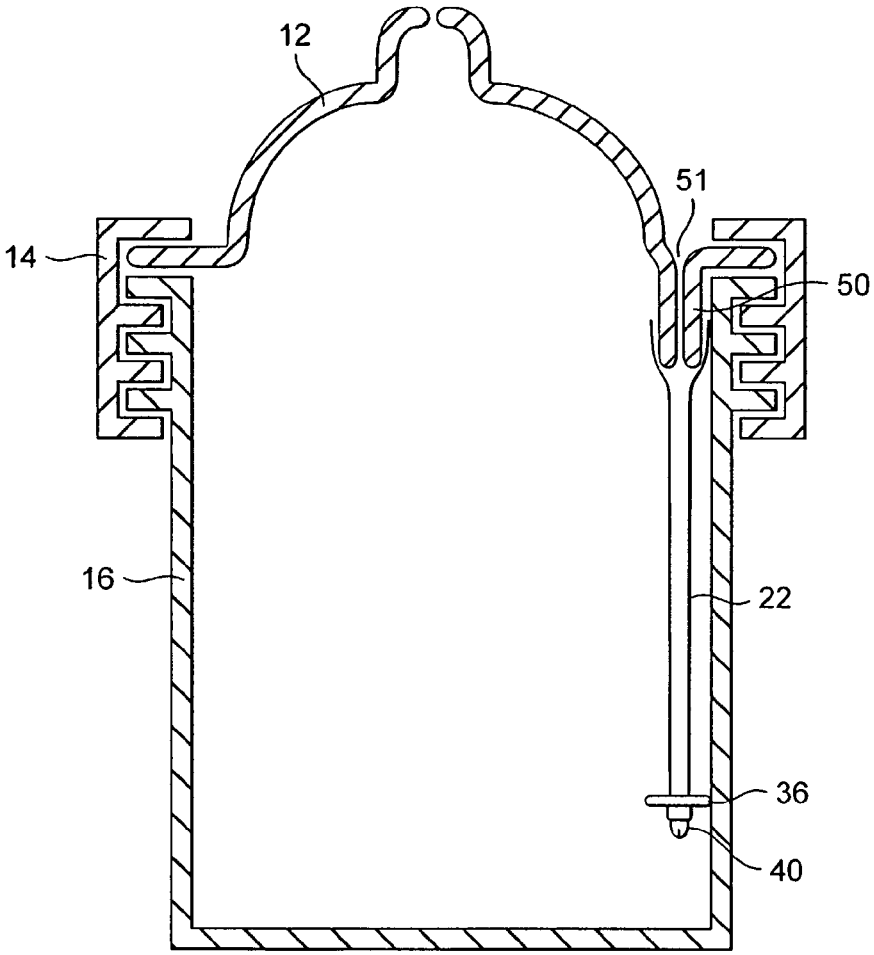
FIG. 5*a* is a sectional side view of a feeding bottle according to a second embodiment of the present invention.
Figure 5B:
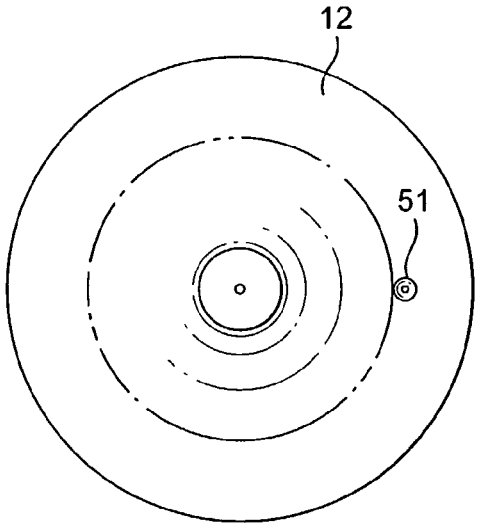
FIG. 5*b* is plan view of the teat according to the second embodiment of the present invention.

FIGS. 5*a* and 5*b* show a second embodiment of the present invention in which there is an alternative air entry system. An air passage is formed by an air inlet aperture 51 on the flange of the teat 12 and an air conduit member 50 projecting downwardly of the teat. The air conduit member 50 provides communication between atmosphere and a vent tube 22 which is attached to the air conduit member with an airtight push fit. The air conduit member 50 can be integrally formed on the flange of the teat 12, for example in the form of a stalk projecting downwardly of the teat at the teat aperture 51. The teat 12 is mounted by screw collar 14 onto container 16.

Figure 6A:
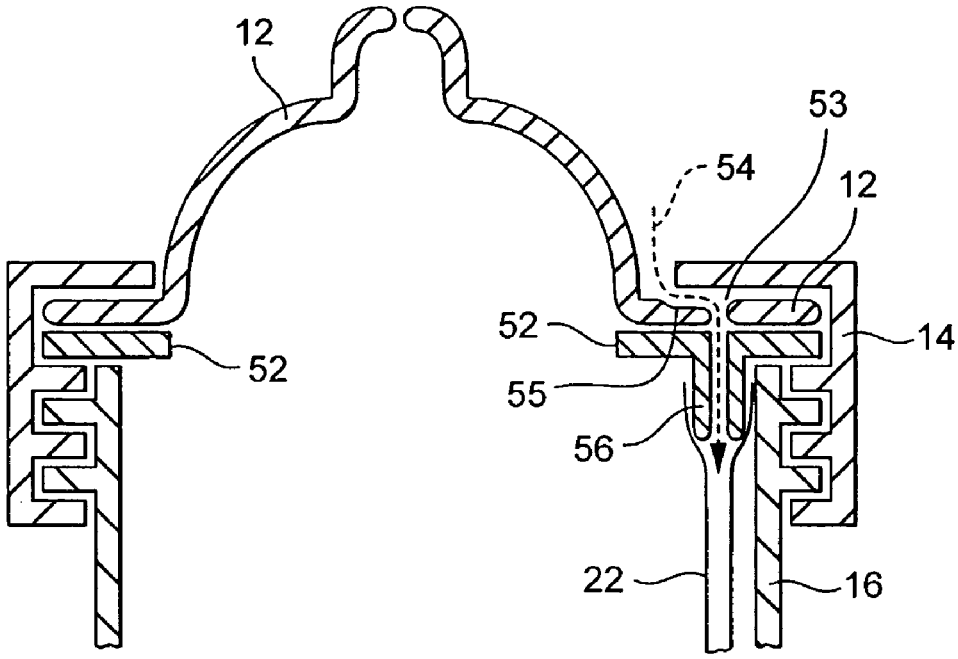
FIG. 6*a* is a sectional side view of a detail of the feeding bottle according to a third embodiment of the present invention.
Figure 6B:
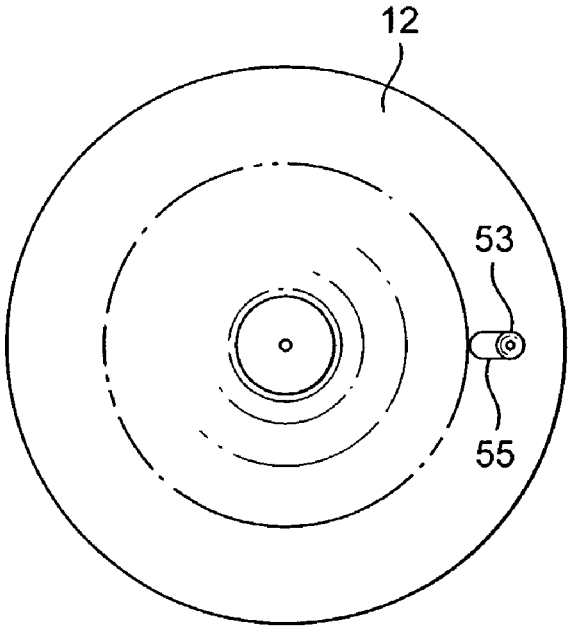
FIG. 6*b* is plan view of the teat according to the third embodiment of the present invention.
Figure 7A:
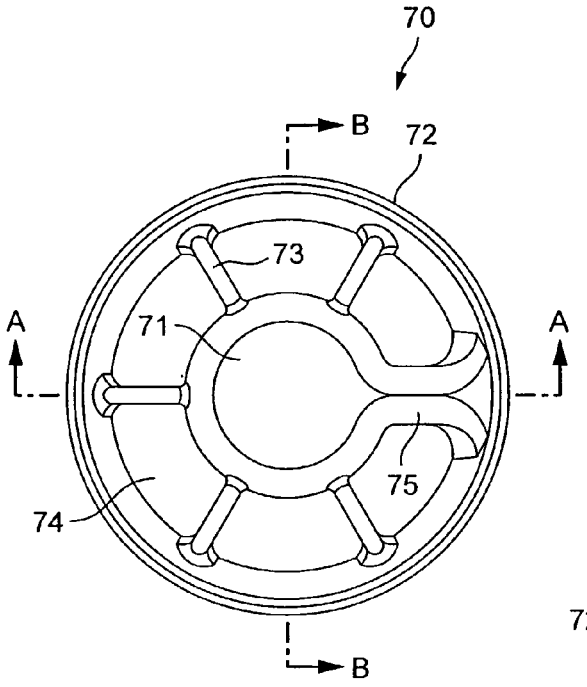
FIG. 7*a* is a plan view of an alternative feeding bottle head portion.
Figure 7B:
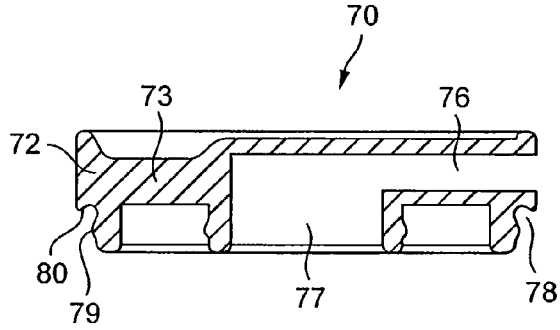
FIG. 7*b* is a sectional view along the line A-A of the feeding bottle head portion of FIG. 7*a;*
Figure 7D:
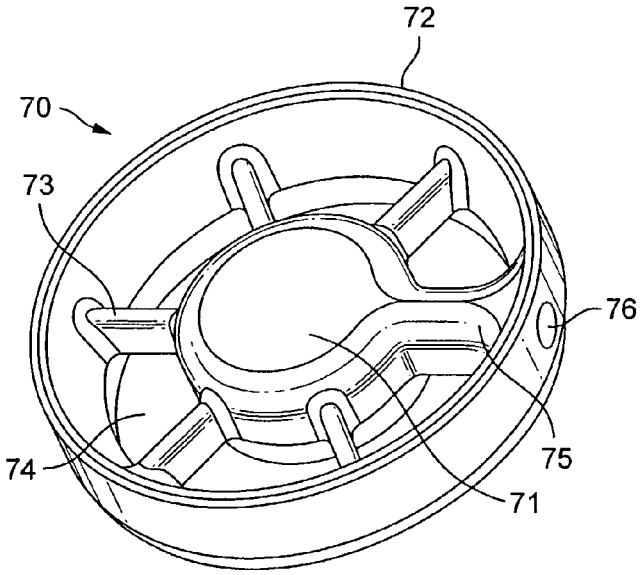
FIG. 7*c* is a sectional view along the line B-B of the feeding bottle head portion of FIG. 7*a* and FIG. 7*d* is a perspective view of the feeding bottle head portion of FIG. 7*a.*
Figure 7C:
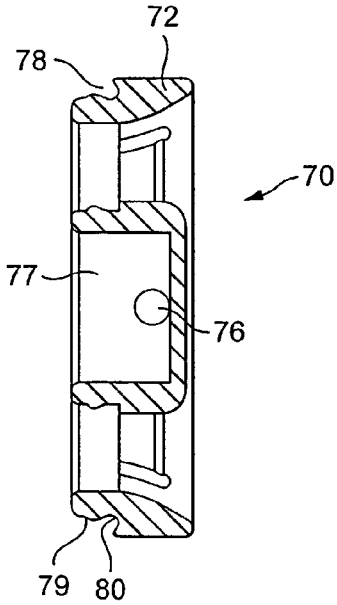

In a third embodiment of the present invention, as shown in FIG. 6, the air conduit member 56 is integrally formed on a support member, for example in the form of a sealing ring 52. The air conduit member 56 projects downwards of the sealing ring 52. The sealing ring 52 is of similar diameter to container 16 and arranged to fit on the lip of the container to be gripped in a liquid tight condition by the flange of teat 12 pressed down by collar 14. The sealing ring 52 additionally provides support for the flange of the teat 12. A recess 55 is formed on the flange of the teat 12 which leads to an air inlet aperture 53 in the teat. An air passage is formed between the flange recess 55 and the screw collar 14 which allows for the passage of air from atmosphere through the aperture 53 on the flange of the teat, which is suitably aligned above the conduit member 56 on the ring 52, and air conduit member 56 to the vent tube 22, as shown by dotted arrow 54. The vent tube 22 is attached to the air conduit member 56 with an airtight push fit.

FIGS. 7*a* to 7*d* show an alternative feeding bottle insert head portion 70. As can be seen the head portion includes hub 71 connected to a rim 72 by spokes 73. A liquid conduit is formed by spaces 74 between the hub 71, rim 72 and spokes 73. The liquid conduit provides communication between the container 16 and the teat 12 (neither shown) such that when the feeding bottle is inverted liquid passes from the container through the spaces 74 and into the teat allowing an infant to feed.

At least one of the spokes 75 is of sufficient thickness to allow a generally radial bore to be formed therethrough providing an air passage 76 to an open ended chamber 77. The air passage 76 communicates the vent tube 22 (not shown), which is attached to an open ended chamber 77 by push fit and projects downwardly of the head portion 70, to the atmosphere via the screw threads of the collar 14 (not shown).

An annular recess 78 in the underside of the generally annular shaped rim 72 provides a liquid tight seal between the head portion and the container 12 (not shown). The recess 78 is formed such that an inner surface 79 fits inside the container and an upper surface 80 rests on the lip of the container.

It will be appreciated that the various parts of the feeding bottles described above can be made with any appropriate material and in particular the teat 12, collar 14 and container 16 can be made of any standard material. The vent tube 22 is preferably made of generally rigid, inert material such as plastics material and the valve 34 or 40 can be made of silicone rubber or other appropriate material for the purposes required. The flange 36 is preferably made of rigid plastic material allowing mixing and an anti-choke function and can be two-shot moulded with the valve 34 or 40 if appropriate. In the embodiments discussed various elements are connected by push fit allowing easy disassembly and cleaning but any appropriate manner of connection can be adopted and indeed where appropriate the various parts can be formed integrally or non-detachably. The head portion 20 is preferably of a semi-rigid material ensuring that the air passage 26 is not closed by deformation of the flange portion 28 but at the same time a reliable liquid tight seal is provided at the neck of the container. Similarly the support member of the third embodiment is preferably of a semi-rigid material ensuring that the air conduit member 56 is not closed by deformation when push fitted to the vent tube 22 but at the same time a reliable liquid tight seal is provided at the neck of the container 16.

The neck insert 18 can be integral with the container/collar or can be detachable as appropriate for cleaning purposes. In particular the neck insert 18 can provide a simple modular attachment to a standard feeding bottle and in many cases the existing collar can be used in cooperation with the neck insert 18. Alternatively the neck insert 18 can be provided with a specially tailored collar of appropriate depth to ensure good screw-thread engagement.

As a result of the arrangement described herein various advantages are provided. The valve allows natural feeding by venting at very low pressure. Because the vent tube 22 is valved at its base, pressure equalisation is provided within the container without allowing the infant to deform the teat and push liquid away from the teat. Also, because the valve provides a liquid seal there is no risk of leakage of liquid through the neck insert and down the side of the container. A simple and modular arrangement is provided for the neck insert. By virtue of the addition of a valve flange mixing and stirring can be improved whilst choke hazards can be avoided.

It will be appreciated by a skilled person that any appropriate type of valve can be used in place of the duck-billed valve or hemispherical valve described above. The dimensions of the container and the various components can be varied as appropriate and the specific positioning of the various elements can be rearranged as appropriate. Similarly any other appropriate shape and positioning of the valve flange can be adopted. Although the discussion above is directed to a feeding bottle a similar approach can be used in any drinking vessel with any type of mouthpiece or feeding or drinking closure where the desire is to provide pressure equalisation.

The invention claimed is:

1. A feeding bottle comprising a container, a flange portion arranged at an air inlet end of the feeding bottle and an air conduit extending from said flange portion into the container in a direction substantially perpendicular to the plane of said flange portion, the conduit having a vent valve at its distal end, the vent valve being configured to close as a result of the pressure of a head of liquid in the container and to open under a negative pressure applied to the container in the range of approximately 1 mB to 25 mB.

2. A feeding bottle as claimed in claim 1 in which the vent valve comprises a duck-billed valve.

3. A feeding bottle as claimed in claim 1 in which the vent valve comprises a hemispherical valve.

4. A feeding bottle as claimed in claim 1 further comprising an air conduit extending from an air inlet end into the container and having the vent valve at a distal end, the vent valve being configured to close as a result of the pressure of a head of liquid in the container and to open under a negative pressure applied to the container.

5. A feeding bottle as claimed in claim 1 further comprising an air vent assembly comprising an air conduit extending from an air inlet end into the container and wherein the vent valve is a one way valve at the distal end, the air conduit further including an anti-choke portion extending laterally from the air conduit at the distal end.

6. A feeding bottle as claimed in claim 5 in which the anti-choke portion is attached to the one way valve.

7. A feeding bottle as claimed in claim 6 in which the anti-choke portion and valve are integrally formed and removably attached to the air conduit.

8. A feeding bottle as claimed in claim 5 in which the vent assembly further includes a sealing portion sealable against the container opening, the sealing portion including a liquid passage between the container and a mouthpiece.

9. A feeding bottle as claimed in claim 8 in which the sealing portion further includes a vent passage providing an air passage to the air conduit.

10. A feeding bottle as claimed in claim 5 further comprising a teat having an air conduit member providing an air passage to the air conduit.

11. A feeding bottle as claimed in claim 5 further comprising a support member having an air conduit member providing an air passage to the air conduit.

12. A feeding bottle as claimed in claim 1 wherein the negative pressure is in the range of about 5 mB to 15 mB.

13. A feeding bottle as claimed in claim 1 wherein the negative pressure is approximately 10 mB.

14. A feeding bottle vent valve configured to close as a result of the pressure of a surrounding head of liquid and to open to a venting position upon application of a negative pressure of between approximately 1 mB and 25 mB.

15. A feeding bottle vent valve as claimed in claim 14 wherein the negative pressure is between about 5 mB and 15 mB.

16. A feeding bottle vent valve as claimed in claim 14 wherein the negative pressure is approximately 10 mB.

* * * * *